United States Patent [19]

Bremenkamp

[11] 4,262,812

[45] Apr. 21, 1981

[54] TOOL APPARATUS FOR SPRINKLER SYSTEMS

[76] Inventor: John P. Bremenkamp, Rte. 2, Colby, Kans. 67701

[21] Appl. No.: 895,248

[22] Filed: Apr. 10, 1978

[51] Int. Cl.[3] ..... B66C 1/42; B66C 3/00

[52] U.S. Cl. ..... 212/243; 212/182; 414/23; 414/460; 414/626; 254/280; 254/360; 144/285; 296/37.1

[58] Field of Search ..... 414/745, 747, 460, 626, 414/729, 543, 749, 508, 23; 212/145, 8 B, 243; 137/344, 615; 254/139.1; 239/167

[56] References Cited

U.S. PATENT DOCUMENTS

| | | | |
|---|---|---|---|
| 1,840,998 | 1/1932 | Alban | 212/8 B |
| 3,305,113 | 2/1967 | Gardner | 414/508 |
| 4,020,952 | 5/1977 | Scodino | 212/145 X |
| 4,044,902 | 8/1977 | Eitel | 414/680 |

FOREIGN PATENT DOCUMENTS

| | | | |
|---|---|---|---|
| 762685 | 4/1958 | United Kingdom | 414/460 |

*Primary Examiner*—Lawrence J. Oresky
*Attorney, Agent, or Firm*—Phillip A. Rein

[57] ABSTRACT

This invention is a tool apparatus operable to aid in assembling and disassembling of large, rotational sprinkler systems for crop irrigation purposes. The tool apparatus function is to present the tools and the structure for readily maneuvering the elements of the respective irrigation sprinkler system. More particularly, the tool apparatus includes (1) a basic support assembly resembling a flat bed trailer to be pulled behind a truck, tractor, or the like; (2) a tower support assembly connected to the basic support assembly; (3) a collapsible tower assembly connected to the tower support assembly and pivotal relative thereto to be accessible to irrigation pipe members; (4) a tool and parts bin assembly to contain and separate the tools and parts needed for use on the sprinkler system; (5) a tool power assembly having an air compressor assembly to provide air power for tool members; and (6) a personnel support assembly operable to support one in an elevated position to connect and disconnect adjacent irrigation pipe members. The tower assembly is foldable from a transport position to an upright, usage position and includes two (2) winch assemblies operable to move the pipe members as required. All the aforementioned elements of the tool apparatus cooperate to present the structure necessary to effectively assemble and disassemble the irrigation sprinkler system with a minimum amount of effort.

10 Claims, 9 Drawing Figures

TOOL APPARATUS FOR SPRINKLER SYSTEMS

PRIOR ART

The following patents were noted in our search relative to cranes and structures to move irrigation type pipe members.

U.S. Pat. Nos. 3,858,731; 3,657,686; 3,515,296; 2,780,376; 3,685,670; 3,034,668; 2,704,162; 1,765,295; 1,790,692.

The Allen and Beckman patents teach the use of crane structures mounted on tractor members being operable to move irrigation pipe members.

The Johnson, Wicks, and Wiswell, Jr. patents teach devices to move and align pipe members for connection to each other.

The other references pertain to usage on pipe members on a ground surface.

None of the references teach the overall combination of elements being available to assembly and disassemble irrigation pipe members in an elevated sprinkler system.

PREFERRED EMBODIMENT OF THE INVENTION

In one preferred embodiment of the invention, the tool apparatus for sprinkler systems includes a basic support means resembling a trailer assembly; a tower support means mounted on the basic support means; a collapsible tower means pivotally connected to the tower support means; a tool and parts bin means connected to the basic support means; a tool power means mounted on the basic support means operable to supply pressurized air to power tool members; and a personnel support means operable to support a person in an elevated manner for working on adjacent pipe members. The tower support means includes a tower support frame to receive the tower means thereon for movement from usage to a collapsed, transport position. The tower means includes a collapsible A-frame tower assembly having (1) a first tower leg assembly with one end connected to the tower support frame; (2) a second tower leg assembly having one end pivotally connected to another end of the first tower leg assembly; (3) a support wheel assembly connected to another end of the second tower leg assembly for movement of the entire A-frame tower assembly; and (4) a power winch assembly mounted at the junction of the first and second tower leg assemblies for connection to the irrigation pipe members. Further, the tower means includes a pivotal pipe support assembly connected to a lower end of the second tower leg assembly to also move selected ones of the irrigation pipe members. The tool and parts bin means includes separate areas and elements to receive, anchor, and store various tools and parts needed for working on the subject sprinkler system. The personnel support means includes a vertically extended post having a step member thereon usable to gain access to a higher horizontal support assembly to receive and support a person thereon for working on elevated irrigation pipe members.

OBJECTS OF THE INVENTION

One object of this invention is to provide a tool apparatus for irrigation sprinkler system that is readily movable to a desired working area and having all the tool, parts, and power requirement therewith to assemble and disassemble elongated irrigation pipe members which form an elevated, rotatable sprinkler system.

One other object of this invention is to provide a tool apparatus for a sprinkler system including a tower means to form an A-frame structure over the pipe members being worked upon and having a power winch assembly operable to grasp and manipulate the pipe members as desired.

Still, another object of this invention is to provide a tool apparatus for a sprinkler system that is self contained with all tools and parts required; includes a tower means to aid in connecting of irrigation pipe members; has an independent power means to supply air to power tools; further includes elements necessary for the control of irrigation pipe members for the connection or disconnection thereof.

One further object of this invention is to provide a tool apparatus for a sprinkler system that is readily transportable; foldable in a compact form for movement on highways; self contained with all power, tools, and parts requirement; and durable in construction.

Various other objects, advantages, and features of the invention will become apparent to those skilled in the art from the following discussion, taken in conjunction with the accompanying drawings, in which:

FIGURES OF THE INVENTION

Figure 1:
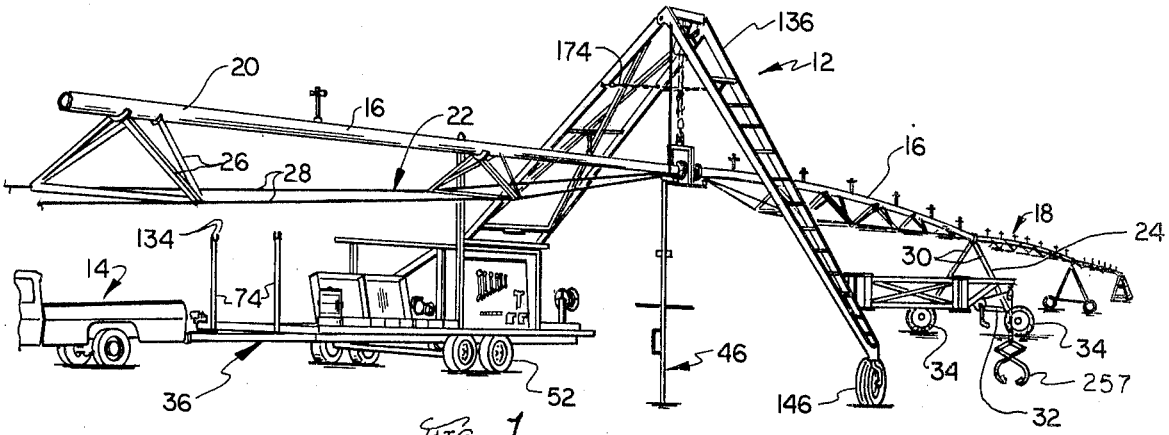
FIG. 1 is a perspective view of a tool apparatus of this invention in the extended usage condition and shown as working on a portion of an irrigation sprinkler system.

The following is a discussion and description of preferred specific embodiments of the new tool apparatus for sprinkler systems of this invention, such being made with reference to the drawings, whereupon the same reference numerals are used to indicate the same or similar parts and/or structure. It is to be understood that such discussion and description is not to unduly limit the scope of the invention.

SPECIFICATION OF THE INVENTION

Referring to the drawings in detail and, in particular to FIG. 1, a tool apparatus of this invention, indicated generally at 12, is shown as connected to a pick-up truck 14 and being used to connect pipe members 16 of an irrigation sprinkler system 18. The sprinkler system 18 is of the type to rotate about a central point to irrigate large areas of circular crop areas.

The sprinkler system 18 includes an elongated sprayer means 20 having a plurality of the pipe members 16 connected in a straight line and pivotal about a center point thereof. The sprayer means 20 includes the adjacent pipe members 16 supported by a cable support assembly 22 and spaced ones vertically mounted on support wheel assemblies 24. The cable support assemblies 22 include support tresses 26 connected to cable members 28 to form a tension type support for the connected pipe members 16. Each support wheel assembly 24 includes divergent support members 30 connected to a support axle 32 at a lower end thereof and having a wheel member 34 mounted on each outer end of the support axle 32. The spaced wheel members 34 are generally aligned with each other to permit rotational movement of the sprayer means 20 about a central pivot point (not shown). It is noted that the cable support assemblies 22 are necessary between the support wheel assemblies 24 to hold the pipe members 16 in the proper arched, supported position for dispensing irrigation water therefrom.

The sprayer means 20 is supplied with irrigation water under pump pressure at the central pivot point for dispensing thereof through openings in the interconnected pipe members 16.

The tool apparatus 12 of this invention is necessary and important in order to assembly and disassemble the sprayer means 20 with a minimum amount of time and energy. This is important as these units are very expensive and one unit may serve several circular areas of crop growth with savings of time and labor very important and achieved by this invention.

The tool apparatus 12 includes (1) a basic support means or assembly 36; (2) a tower support means or assembly 38 mounted on the basic support means 36; (3) a collapsible tower means or assembly 40 pivotally connected to the tower support means 38; (4) a tool and parts bin means or assembly 42 mounted on the basic support means 36; (5) a tool power means or assembly 44 to supply pressurized air; and (6) a personnel support means or assembly 46 to support a person while working on the sprinkler system 18.

The basic support means 36 includes an elongated support bed assembly 48; a connector tongue assembly 50 connected to one end of the support bed assembly 48; and a support wheel assembly 52 secured to a mid-section 54 of the support bed assembly 48. The support bed assembly 48 includes a rectangular bed member 56 having an upper, horizontal support surface 58.

The connector tongue assembly 50 includes a pair of convergent, connector members 60 having a ball hitch member 62 secured at their junction and vertical support stand 63 secured to one of the connector members 60. The ball hitch member 62 is of a conventional type connectable to a hitch ball member on a car or truck as shown in FIG. 1.

The support wheel assembly 52 includes a dual set of wheel members 64, each set mounted on an axle member 66 and connected to the bed member 56 through axle spring members 68.

Figure 8:
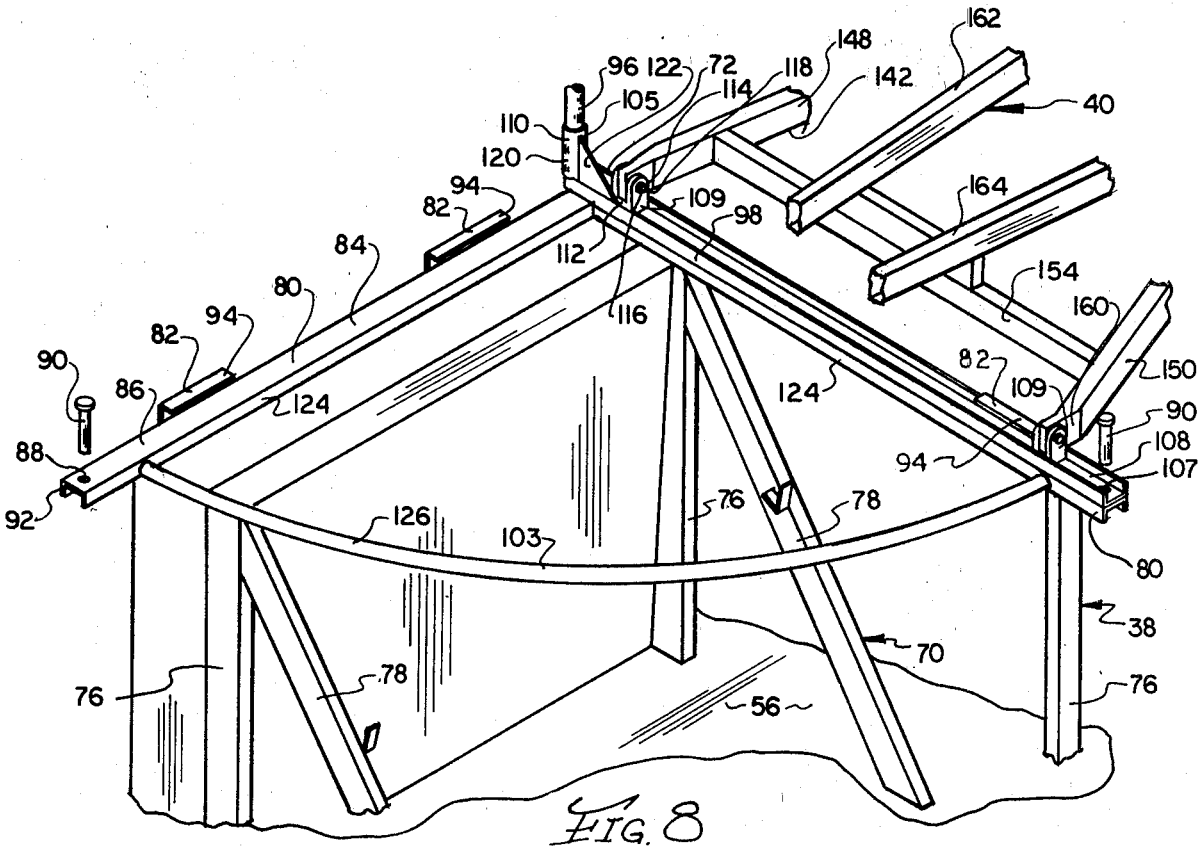
FIG. 8 is a fragmentary perspective view showing a tower support means with a portion of the tower means connected thereto.
Figure 9:
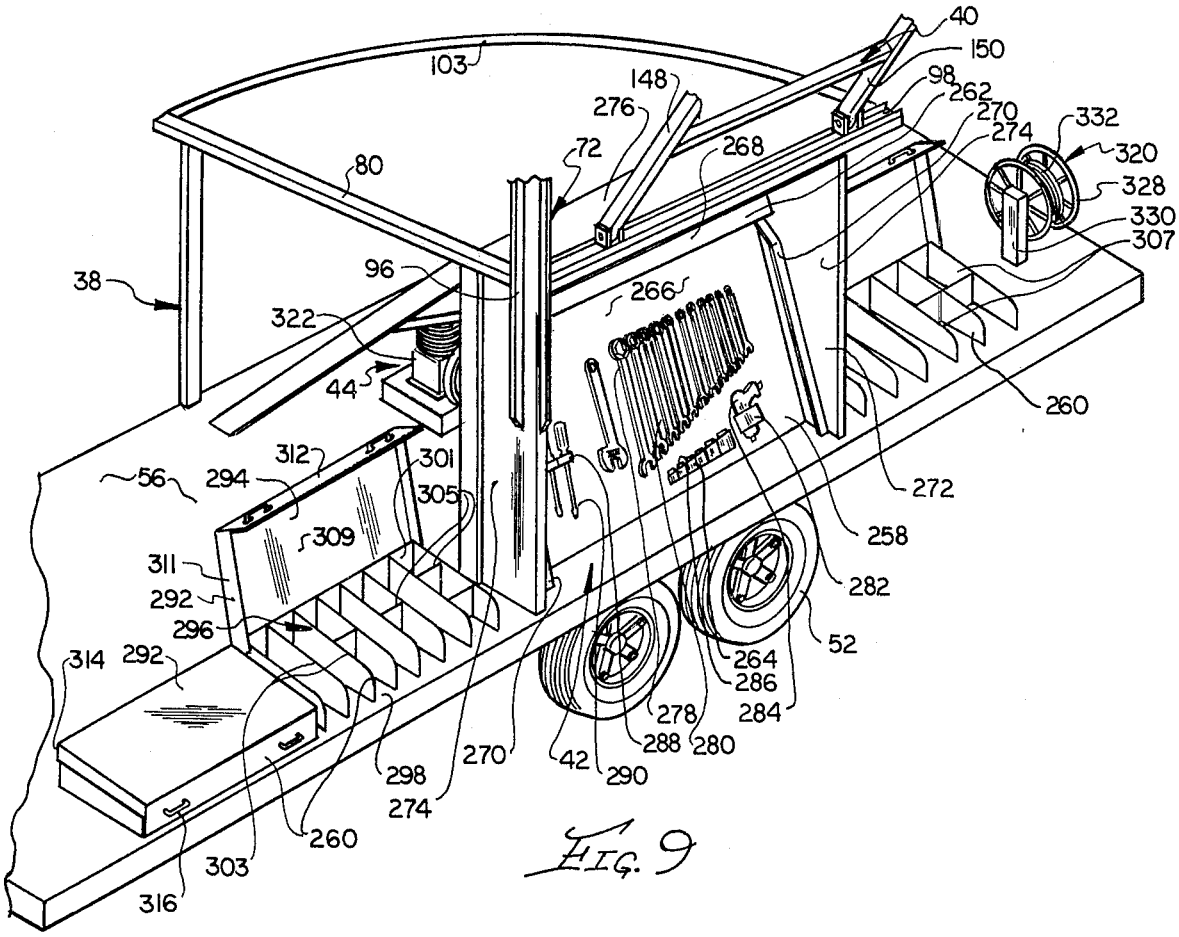
FIG. 9 is a fragmentary perspective view of the tool apparatus of this invention and specifically illustrating the tool and parts bin means of this invention.

As shown in FIGS. 8 and 9, the tool support means 38 includes (1) a basic support frame 70 secured to the bed member 56; (2) a tower support frame 72 secured to the basic support frame 70; and (3) a pair of upright support arms 74 secured to the connector members 60 of the connector tongue assembly 50. The basic support frame 70 includes three, spaced vertical support posts 76 anchored at lower ends to the bed member 56; parallel lateral support members 78 mounted between an upper end of two of the support posts 76 and the bed member 56; a pair of horizontal support channels 80; and lateral stop members 82 connected to the support channels 80.

The support channels 80 are secured to each other at one end at a 90 degree angle and provide upper surfaces 84 in a common horizontal plane for reasons to be explained. An outer end section 86 of each support channel 80 is formed with a hole 88 to receive a lock pin 90 therein for reasons to be explained.

The stop members 82 are of L-shape and secured to a sidewall 92 of the respective support channels 80. A short leg 94 of the stop members 82 restrain vertical movement of the tower means 40 in a manner to be explained.

The tower support frame 72 includes (1) a vertical support post 96 secured at the junctions of the support channels 80; (2) a main support channel 98 pivotally connected at one end to the support post 96; (3) a winch assembly 101 secured to an upper end of the support post 96; (4) a support pipe member 103 mounted between the support channels 80; and (5) a connector assembly 105 secured to the main support channel 98. The main support channel 98 is substantially identical to the other support channels 80 and having a hole 107 in an outer end section 108 to receive the lock pin 90 therein to selectively secure to respective ones of the support channels 80.

As shown in FIG. 8, the connector assembly 105 includes a pair of spaced anchor lugs 109 and a support tube assembly 110 connected to the support post 96. Each anchor lug 109 is of a U-shape having a main body 112 with parallel connector legs 114. Each connector leg 114 is provided with a hole 116 therein to recieve a connector bolt 118 to pivotally connect the tower means 40 thereto in a manner to be explained.

The support tube assembly 110 includes a tube member 120 mounted about the support post 96 and secured to the main support channel 98; and a gusset plate 122 secured between the tube member 120 and the main support channel 98 for added strength. The tube member 120 is pivotal about the support post 96 to pivot the main support channel 98 and interconnected tower means 40 from a transport to a usage position.

The support pipe member 103 is of an arcuate, quarter circle shape and secured at opposite ends to facing sidewalls 124 of the support channels 80. An upper surface 126 of the support pipe member 103 is in a common plane with the upper surface of the support channels 80. As noted in FIG. 8, this provides support for the main support channel 98 when moved from the transport position to the usage position placed above the other spaced support channel 80.

The support post 96 extends substantially above the main support channel 98 with an upper end provided with a winch connector ring 128.

The winch assembly 101 is of a conventional nature having a pulley member 130 with a cable member 132 mounted thereon. The pulley member 130 is connectable between the connector ring 128 and the tower means 40 to raise and lower same as will be explained.

The parallel upright support arms 74 are provided at upper ends with spaced retainer plates 134 to receive a portion of the tower means 40 therebetween when in the transport position. The retainer plates 134 act to prevent lateral movement of the tower means 40 when supported thereon.

The collapsible tower means 40 includes (1) an A-frame tower assembly 136 connected to the tower support frame 72; (2) a power winch assembly 138 connected to the A-frame tower assembly 136; and (3) a pivotal pipe support assembly 140 connected to the A-frame tower assembly 136. The A-frame tower assembly 136 includes a first tower leg assembly 142 having one end connected to the anchor lugs 109 of the connector assembly 105; a second tower leg assembly 144 having one end pivotally connected to the other end of the first tower leg assembly 142; and a support wheel assembly 146 connected to the other end of the second tower leg assembly 144.

The first tower leg assembly 142 includes longitudinal vertical support members 148, 150; three (3) transverse, parallel support members 151, 152, 154, connected between the vertical support members 148, 150; and diagonal support members 156, 158 secured at opposite ends to upper and lower ones of the transverse support members 151, 154.

As noted in FIG. 8, the lower ends of the vertical support members 148, 150 are formed with connector sections 160 having holes therein to connect by the connector bolts 118 to the anchor lugs 109. This provides a pivotal connection for reasons to become obvious.

The second tower leg assembly 144 includes downwardly convergent support legs 162, 164 secured at one end thereof; a plurality of parallel support arms 166 interconnecting the convergent support legs 162, 164; and an upper support arm 168 pivotally connected to a support shaft 170. An outer end area of the convergent support legs 162, 164 are secured to a support post housing 172 to receive the support wheel assembly 146 therein.

Figure 4:
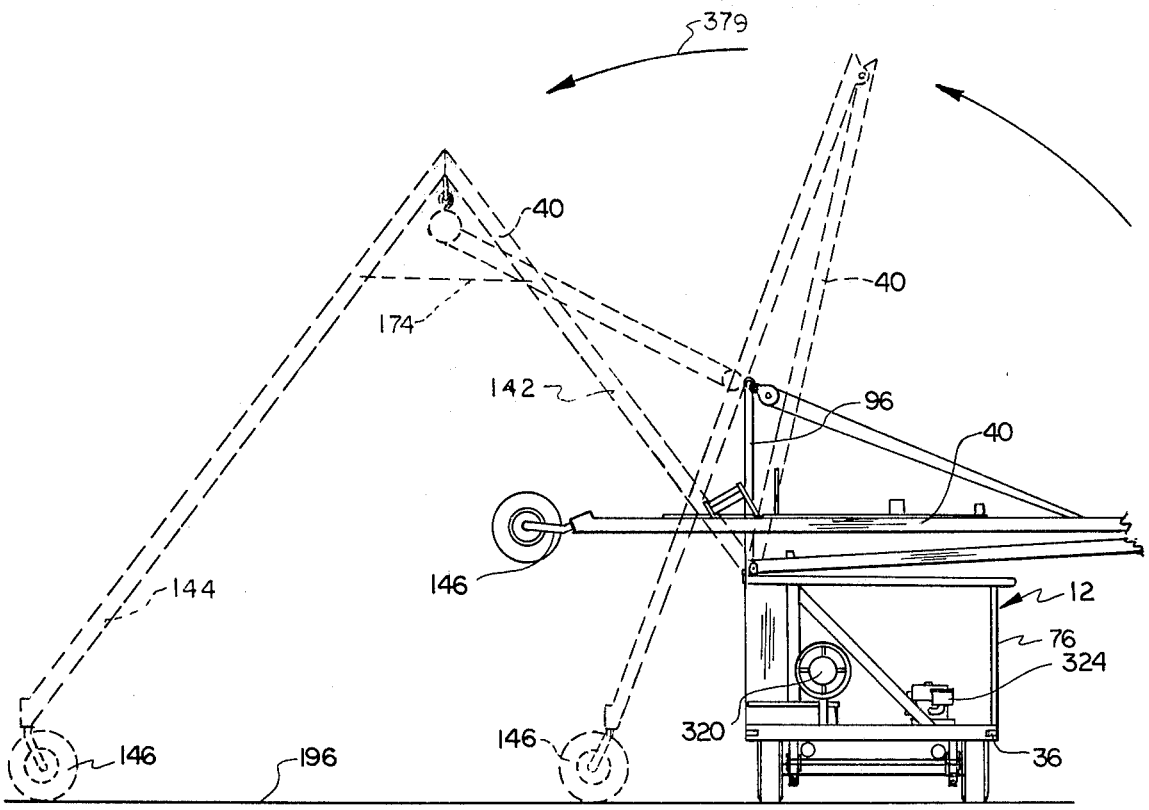
FIG. 4 is a sectional view taken along line 4—4 in FIG. 3 with movement of the tower means shown in dotted lines from the storage position to an elevated A-frame usage position.

The upper ends of the first tower leg assembly 142 and the second tower leg assembly 144 are interconnected for pivotal movement on the support shaft 170 (note pivotal movement in FIG. 4). A connector chain member 174 is operable to restrict outward movement of the second tower leg assembly 144 to the position as shown in FIG. 7.

Figure 5:
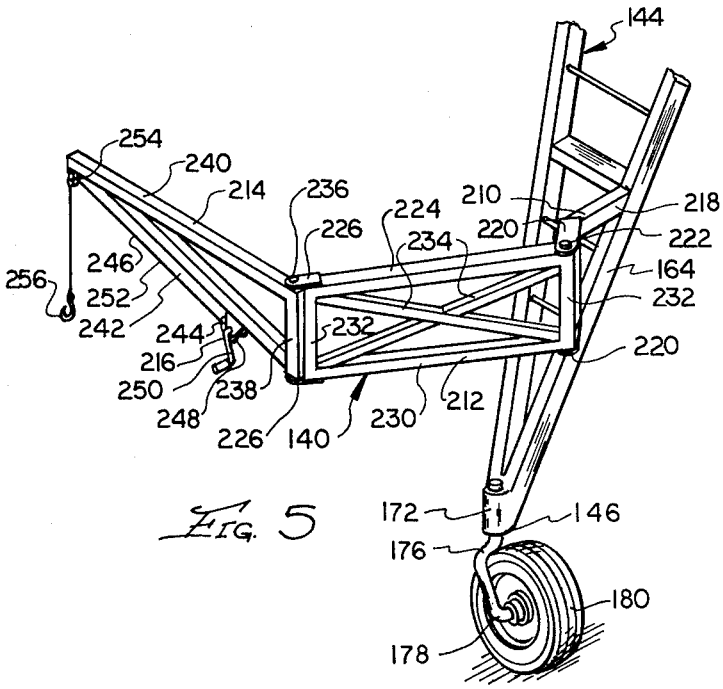
FIG. 5 is a fragmentary prespective view of a pivotal pipe support assembly mounted on a second tower leg assembly of the tower means of this invention.

As shown in FIG. 5, the support wheel assembly 146 includes a pivotal support arm 176 having a portion rotatably mounted in the support post housing 172; a wheel support shaft 178 connected to a lower end of support arm 176; and a tower support wheel member 180 rotatably mounted on the wheel support shaft 178. It is noted that the wheel member 180 sets in the upright vertical position when in the usage position (FIG. 1).

Figure 7:
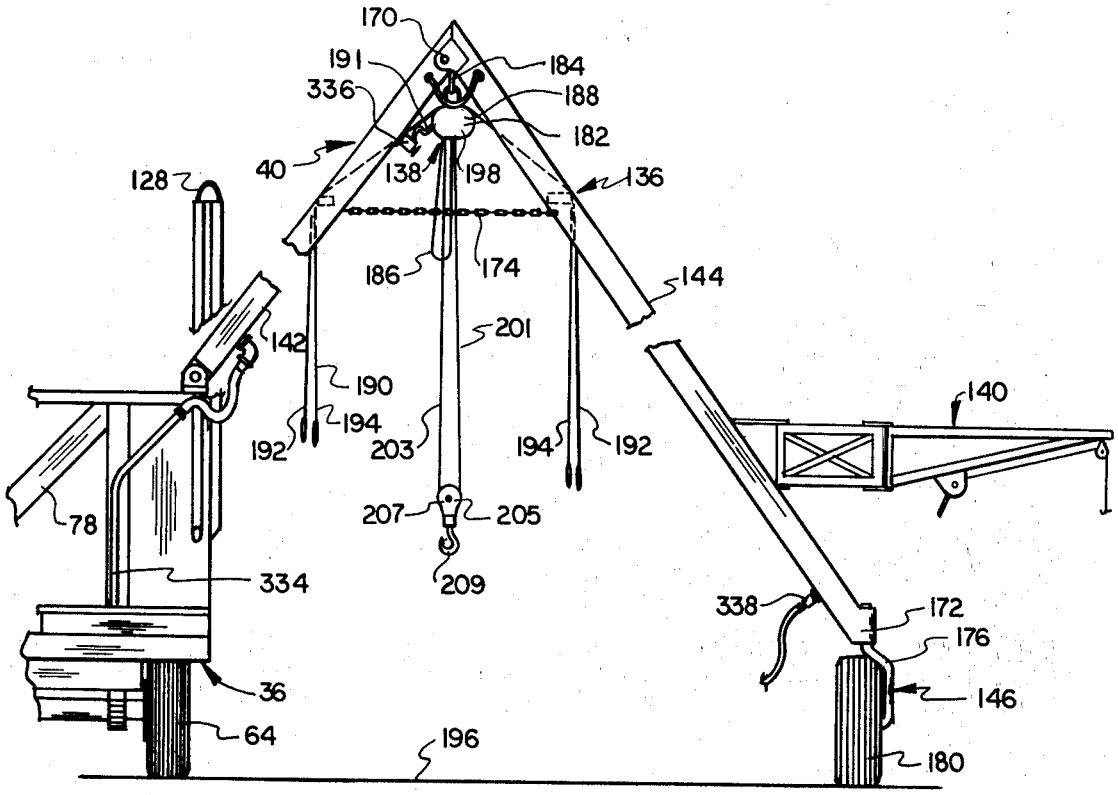
FIG. 7 is a fragmentary elevational view of the tool apparatus of this invention and specifically showing the tower means in the upright, usage position.

As best shown in FIG. 7, the power winch assembly 138 includes a power member 182 connected to a support clamp 184 which is connected to the support shaft 170 and a winch assembly 186 connected to the power member 182. The power member 182 is a fluid drive motor 188 operated through a control cable assembly 190. The drive motor 188 is supplied with pressurized air in a conduit 191 from the tool power means 44.

The control cable assembly 190 includes a dual set of forward control cables 192 and reverse control cables 194. These are such as to be operable by one standing on a ground surface 196 to move the winch assembly 186.

The winch assembly 186 includes a pulley housing 198 having a chain and hook assembly 201 mounted thereon. The chain and hook assembly 201 includes a chain member 203 mounted on a pulley (not shown) in the pulley housing 198 and a pulley and hook member 205 mounted on an outer section of the chain member 203. The pulley and hook member 205 includes a pulley member 207 with a hook member 209 pivotally connected thereto.

As best shown in FIG. 5, the pivotal pipe support assembly 140 is mounted on a support leg 164 of the second tower leg assembly 144. More particularly, the pivotal pipe support asembly 140 includes (1) a connector assembly 210 secured to the support leg 164; (2) a first support assembly 212 pivotally connected to the connector assembly 210; (3) a second support assembly 214 having one end pivotally connected to the first support assembly 212; and (4) a manual winch assembly 216 mounted on the second support assembly 214.

The connector assembly 210 includes a support arm 218 secured at one end to the support leg 164; a pair of parallel spaced offset arms 220; and a connector shaft 222 mounted between the offset arms 220.

The first support assembly 212 includes a box frame 224 pivotally mounted on the connector shaft 222 and having connector lugs 226 extended from an outer end thereof. The box frame 224 includes upper and lower tubes 228, 230 connected to end tubes 232 and all reinforced by diagonal tubes 234. The connector lugs 226 are mounted on the outer end tube 232 and cooperates to hold a vertical support shaft 236 to pivotally support the second support assembly 214 thereon.

The second support assembly 214 includes a vertical end tube member 238 pivotally connected to the vertical support shaft 236; an upper horizontal tube member 240 having one end secured to the end tube member 238; and an inclined tube member 242 also connected at one end to the end tube member 238 and connected at the outer end to the horizontal tube member 240.

The manual winch assembly 216 includes a winch member 244 secured to the inclined tube member 242 and a cable and hook member 246 connected to the winch member 244. The winch member 244 is of a conventional nature having a pulley member 248 rotatable by a crank member 250 to selectively receive and release a cable member from around the pulley member 248.

The cable and hook member 246 includes (1) a cable member 252 connected at one end to the pulley member 248; (2) a support pulley 254 connected to an outer end of the horizontal tube member 240 and having a portion of the cable member 252 trained thereabout; and a cable hook 256 secured to an outer end of the cable member 252. As noted in FIG. 1, a special pipe hook member 257 can be connected to the cable hook 256. The pipe hook member 257 is operable to grasp and move the irrigation pipe members 16.

As shown in FIG. 9, the tool and parts bin means 42 includes a tool bin assembly 258 and a parts bin assembly 260 both mounted on one side of the bed member 56 so as to be readily accessible to the workmen. The tool bin assembly 258 includes a tool housing assembly 262 having tool connector elements 264 mounted thereon.

The tool housing assembly 262 includes an inclined support plate 266; a retractable cover member 268 to enclose the support plate 266 and tools mounted thereon; parallel spaced support tracks 270 to selectively receive the cover member 268 thereon; and a weather shield housing 272. The cover member 268 operates to enclose the support plate 266 for protection and security thereof.

The weather shield housing 272 includes spaced sidewalls 274 interconnected at upper ends by a top wall 276. The shield housing 272 also adds further support to the tower support means 38.

The tool connector elements 264 are secured to the inclined support 266 and includes (1) wrench connectors 278 to hold wrench members 280; (2) power tool holders 282 having a power drive tool 284 and socket members 286 mounted thereon; and (3) screw driver holders 288 holding screw drivers 290 therein.

The parts bin assembly 260 includes three (3) parts container assemblies 292 which are substantially identical so only one need be described in detail. The parts container assembly 292 includes a lid assembly 294 pivotally mounted on a container assembly 296.

The container assembly 296 uses the bed member 56 as a bottom wall 298 and includes a back wall 301; a plurality of parallel retaining walls 303 extended perpendicular to the back wall 301; and transverse separator walls 305 extended between certain ones of the retaining walls 303 to form independent retainer areas indicated at 307.

The lid assembly 294 covers the container assembly 296 and includes a top wall 309 integral with sidewalls 311; a front wall 312 and a back wall 314. The back wall 314 is pivotally connected to the container assembly 296 for movement between opened and closed positions. The front wall 312 is formed with handle members 316 for obvious reasons.

The tool power means 44 includes an air compressor assembly 318 operable to supply pressurized air to a hose container assembly 320 and other areas. The air compressor assembly 318 includes an air pump member 322; a power assembly 324 to drive the pump member 322 and an air storage tank 326 to hold air from the pump member 322. The power assembly 324 is preferably a gasoline powered internal combustion engine so as to be self contained.

The hose container assembly 320 includes a hose reel member 328 mounted on upright post member 330 to the support bed 56 and having an air hose member 332 trained about the reel member 328. The hose member 332 is supplied with pressurized air from the air compressor assembly 318 and is used to power air tools.

As noted in FIG. 7, the pressurized air is also supplied to an air conduit 334 and up the A-frame tower assembly 136 to (1) supply power to a conduit 336 to the power winch assembly 138; and (2) down the second tower leg assembly 144 to a connector air socket 338. The connector air socket 338 is operable to receive an air power tool or the like for work on the irrigation sprinkler system 18.

Figure 6:
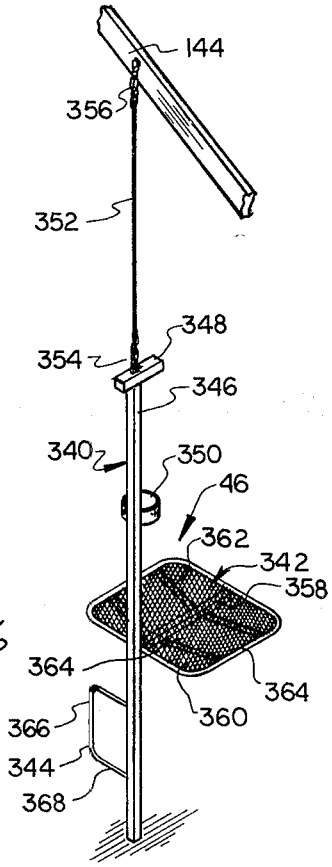
FIG. 6 is a perspective view of a personnel support means of the tool apparatus of this invention.

As shown in FIG. 6, the personnel support means 46 includes a vertical support means 340; a horizontal support assembly 342 connected to a mid-section of the vertical support means 340; and a step member 344 secured to a lower section of the vertical support means 340. The vertical support means 340 includes (1) a vertical support post 346; (2) a transverse support member 348 secured to an upper end of the support post 346; (3) a parts cup member 350 secured to the support post 346; and (4) a support cable 352 connected to the transverse support member 348 through an eyelet 354. The support post 346 is preferably constructed of a square tube material. The parts cup member 350 has an open top end and is used to hold tools, nuts and bolts, etc.

The support cable 352 has a connector snap 356 at the outer end thereof for connection to the second tower leg assembly 144 as noted in the usage position of FIG. 1.

The horizontal support assembly 342 includes a lateral support tube 358 with a support grate member 360 mounted thereon. The support grate member 360 includes a grate 362 mounted on a peripheral frame member 364 to form a support surface 364 for the workmen utilizing same.

The step member 344 is a U-shaped rod member 366 secured to one side of the support post 346. A lower leg 368 of the rod member 366 is operable to receive ones foot thereon as a step before mounting the support grate member 360.

Figure 2:
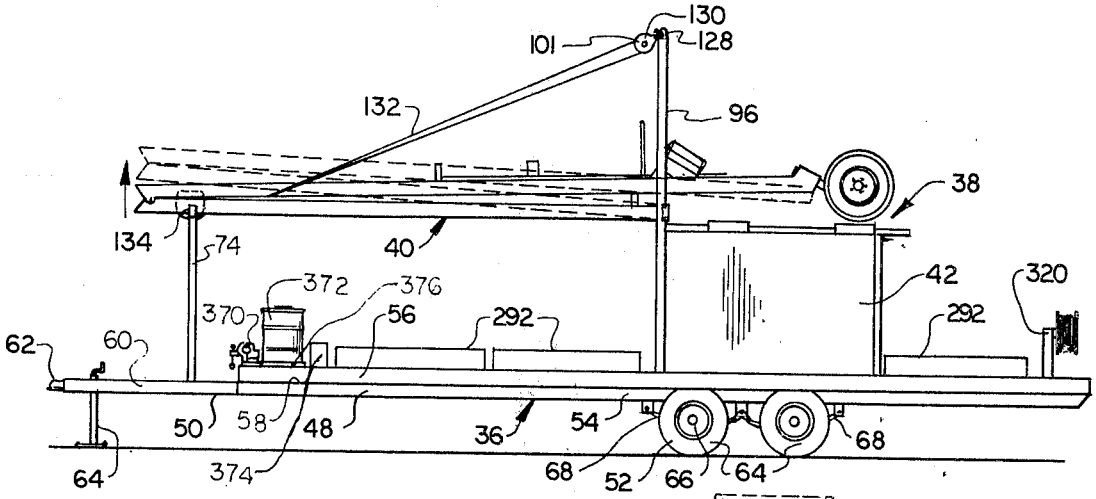
FIG. 2 is a side elevational view of the tool apparatus of this invention in the collapsed, transport condition.
Figure 3:
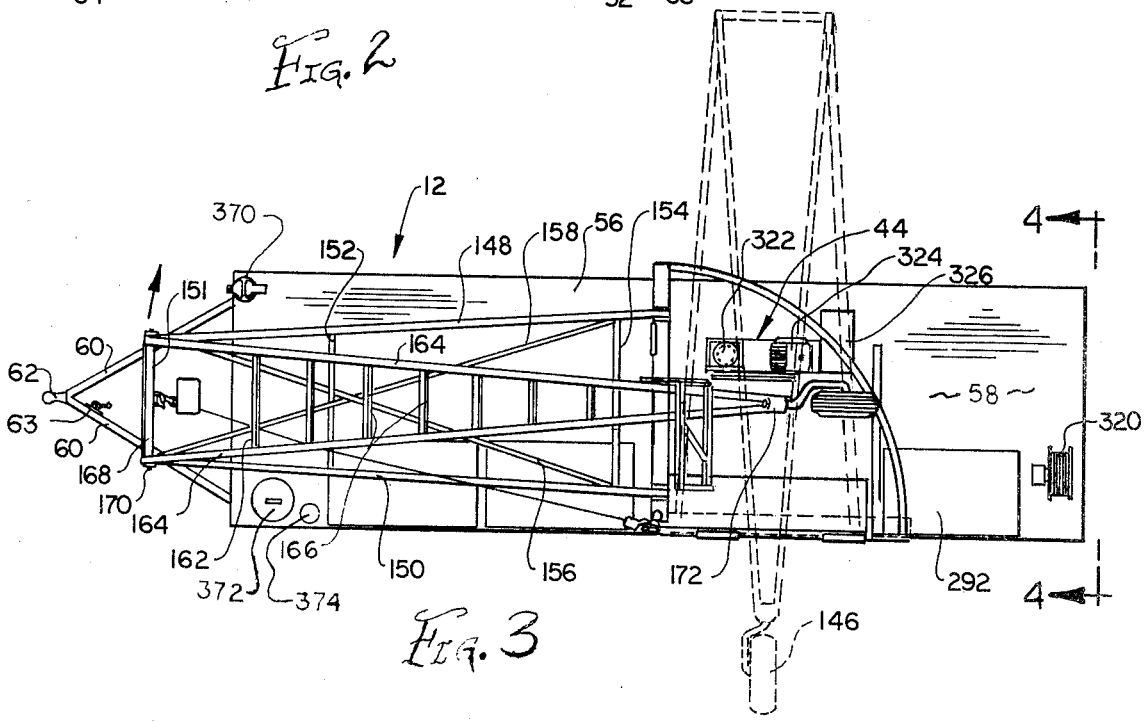
FIG. 3 is a top plan view of the tool apparatus as shown in FIG. 2 with pivotal movement of a tower means shown in dotted lines.

As shown in FIGS. 2 and 3, a forward end of the bed member 56 supports a vise member 370, a water cooler container 372, and a trash container 374. A retainer member 376 acts to hold the water cooler container 372 and prevent lateral movement thereof.

USE AND OPERATION OF THE INVENTION

In the use and operation of the tool apparatus 12 of this invention, we shall assume the tool apparatus 12 is in the transport position as shown in solid lines in FIG. 3. As noted in FIG. 1, a pick-up truck 14 or other such vehicle is connected to the connector tongue assembly 50 in order to move the tool apparatus 12 to the sprinkler system 18 to be worked upon.

The first step is to attach the winch assembly 101 to the connector ring 138 on top of the support post 96. An outer end of the cable member 132 is connected to the tower means 40 as shown in FIG. 2. This acts to free the tower means 40 from the retainer plates 134 mounted on the upper ends of the support arms 74.

Next, the tower means 40 is pivoted about the tower support means 38 while supported on the pipe member 103 to the position shown in dotted lines in FIG. 3. The main support channel 98 is then secured to the adjacent support channel 80 by inserting the lock pin 90 through the holes 88 and 107.

As shown in FIG. 4, the next step is to actuate the winch assembly 101 and pivot the tower means 40 upwardly from the horizontal position to the first dotted line position as indicated by the arrow 378 in FIG. 4. This places the wheel member 180 of the support wheel assembly 146 in contact with the support surface 198.

The second tower leg assembly 144 is then grasped and rolled on the wheel member 180 to the second dotted line position as shown by an arrow 379 in FIG. 4. The connector chain member 174 operates to hold the first tower leg assembly 142 and the second tower leg assembly 144 at an angle of about 75 degrees relative to each other; however, it is obvious that the angle can be adjusted if desired.

It is noted that the A-frame assembly 136 could be moved to the usage position of FIG. 4 with the aid of the power winch assembly 138 if the weight thereof deems such desirable.

The tool bin assembly 258 and the parts bin assembly 260 are then opened to expose the tools and parts necessary to work on the sprinkler system 18.

The personnel support means 46 is connected to the second tower leg assembly 144 to provide an elevated work stand as shown in FIG. 1.

FIG. 1 illustrates the use of the tool apparatus 12 in the usage position to elevate and connect the pipe members 16 of the sprinkler system 18. The power winch assembly 138 is shown holding the pipe members 16 in an elevated position before connecting the support wheel assembly 24 thereto. The cable support assemblies 22 are normally assembled on the ground surface and elevated by the power winch assembly 138.

The tool power means 44 is operable to supply pressurized air wherever needed to drive power tools for working on the sprinkler system 18. The hose reel member 328 allows the air hose member 332 to be used where necessary. Also, the connector air socket 338 on the second tower leg assembly 144 supplied pressurized air for working in the area.

In this same area as shown in FIG. 5, the pivotal pipe support assembly 140 is usable to move the pipe members 16 into proper desired positions. The connector assembly 210 is such that the first support assembly 212 and the second support assembly 214 are movable inwardly of the second tower leg assembly 144. Therefore, the pivotal pipe support assembly 140 can place a pipe member 16 in a proper position under the junction of the first tower leg assembly 142 and the second tower leg assembly 144. The pipe hook member 257 resembles a pair of ice tongs and act to grasp the pipe members 16 for moving same.

It is seen that the tool apparatus of this invention is designed to provide all of the tools, parts, winches, and power supply needed to assembly and disassemble an irrigation sprinkler system. The tool apparatus is readily movable down the longitudinal axis of the irrigation pipe members behind a pick-up truck or other such vehicles. The tower means is readily moved from the transport to the erected usage position by the tool apparatus and can be done by one person.

The tool apparatus is sturdy in construction, easy to use, safe in operation, and collapsible so as to be trailable on the highways. The power means is gasoline powered so as to be independent in operation not requiring any external power source.

While the invention has been described in conjunction with preferred specific embodiments thereof, it will be understood that this description is intended to illustrate and not to limit the scope of the invention, which is defined by the following claims.

I claim:

1. A tool apparatus used to assemble and disassemble a plurality of pipe members of an irrigation sprinkler system used for commercial crop production, comprising:

(a) a basic support means having a support bed assembly mounted on a support wheel assembly so as to be readily mobile;

(b) a tower support means mounted on said basic support means;

(c) a collapsible tower means pivotally connected to said tower support means and movable from a transport position overlying said support bed assembly to a usage position extended laterally of said support bed assembly;

(d) said tower means includes a tower assembly operable to straddle the pipe members when in the usage position in order to work and elevate the pipe members of the sprinkler system;

(e) said tower support means includes a basic support frame secured to said support bed asssembly, and a tower support frame secured to said basic support frame;

(f) said basic support frame includes a pair of interconnected channel members providing a horizontal plane to receive a portion of said tower means therein, (g) said tower support frame includes a vertical support post at the junction of said channel members and a main support channel pivotally connected to said support post;

(h) said tower assembly pivotally connected to said main support channel; and (i) said main support channel and interconnected said tower assembly movable from the transport position over one of said channel members to the usage position over the other channel member.

2. A tool apparatus as described in claim 1, wherein:

(a) said tower assembly being of A-frame shape includes a first tower leg assembly pivotally connected at one end to said tower support means; a second tower leg assembly pivotally connected at one end to another end of said first tower leg assembly; a connector member mounted between said first tower leg assembly and said second tower leg assembly to limit relative outward movement thereof in the usage position; and a support wheel assembly mounted on another end of said second tower leg assembly to contact the ground surface for ease of longitudinal movement of said tool apparatus;

(b) said A-frame tower assembly includes a power winch assembly mounted between the junction of said first tower leg assembly to said second tower leg assembly;

(c) said power winch assembly includes a power member connected to a winch assembly;

(d) said winch assembly having a chain and hook assembly operable to grasp and maneuver the pipe members to assemble and disassemble same;

(e) a tool power means mounted on said support bed assembly having a pump member driven by a power assembly to supply pressurized air to said power winch assembly and to a hose container assembly; and (f) said hose container assembly including an air hose member mounted on a hose reel member whereby said hose member is trained about said hose reel member and may be extended for use to drive air powered tool members.

3. A tool apparatus as described in claim 1, wherein:

(a) said tower means includes a pivotal pipe support assembly connected to said second tower leg assembly;

(b) said pivotal pipe support assembly includes a connector assembly secured to said second tower leg assembly; a first support assembly pivotally connected to said connector assembly; a second support assembly pivotally connected at one end to said first support assembly; and a winch assembly connected to an outer end of said second support assembly; whereby said winch assembly and said second support assembly are readily movable laterally of said second tower leg assembly to grasp and convey the pipe members as required.

4. A tool apparatus as described in claim 1, including:

(a) a tool and parts bin means mounted on said support bed assembly including a tool bin assembly and a parts bin assembly; and (b) said tool bin assembly includes a tool housing assembly having an inclined support plate; a cover member operable to selectively open and close access to said support plate; and tool connector elements secured to said support plate to hold tool members thereon.

5. A tool apparatus as described in claim 4, wherein:
(a) said tool connector elements include wrench connections to hold wrench members thereon; power tool holders to hold power drive tools and socket members thereon; and screw driver holders to hold screw drivers thereon.

6. A tool apparatus as described in claim 4, wherein:
(a) said parts bin assembly includes three parts container assemblies mounted on said support bed assembly; and
(b) each of said parts container assemblies include a container assembly having a back wall, parallel retaining walls extended perpendicular to said back wall, and transverse separator walls extended perpendicular to said retaining walls to form independent parts retainer areas therebetween.

7. A tool apparatus as described in claim 6, wherein:
(a) said parts container assembly having a lid assembly pivotally connected to said back wall and movable from closed to opened position to reveal said parts retainer areas and hold parts therein in the closed position during transport.

8. A tool apparatus as described in claim 1, wherein:
(a) said lower support frame includes a winch assembly connected to an upper end of said vertical support post and connected to said tower assembly to aid in moving same from the collapsed transport position to the extended upright usage position.

9. A tool apparatus as described in claim 1, including:
(a) a personnel support means releasably connected to an upper most portion of said tower assembly when in the usage position;
(b) said personnel support means having a horizontally extended support assembly below the pipe members and connected to a vertical support post to support a person thereon when working on the pipe members of the sprinkler system; and
(c) said personnel support means includes a vertical support post; a transverse support member connected to an upper end of said vertical support post, and a support cable to connect said transverse support member to said tower means to hold it in a vertically extended position.

10. A tool apparatus as described in claim 9 wherein:
(a) said personnel support means includes a parts cup member secured to said support post between said transverse support member and said horizontal support assembly, and a step member secured to said support post below said horizontal support assembly thereby whereby a workman may mount said step member and then said horizontal support assembly to work on the sprinkler system.

* * * * *